US006651552B1

(12) United States Patent
Didonato

(10) Patent No.: US 6,651,552 B1
(45) Date of Patent: Nov. 25, 2003

(54) AUTOMATED CAN DECORATING APPARATUS HAVING MECHANICAL MANDREL TRIP

(75) Inventor: Russell Didonato, Maplewood, NJ (US)

(73) Assignee: Sequa Can Machinery, Inc., East Rutherford, NJ (US)

( * ) Notice: Subject to any disclaimer, the term of this patent is extended or adjusted under 35 U.S.C. 154(b) by 0 days.

(21) Appl. No.: 10/200,817

(22) Filed: Jul. 22, 2002

(51) Int. Cl.[7] ..... B41F 17/22
(52) U.S. Cl. ..... 101/40; 101/247; 118/230
(58) Field of Search ..... 101/35, 36, 38.1, 101/39, 40, 40.1, 247; 118/230, 233, 239, 675, 676, 678

(56) References Cited

U.S. PATENT DOCUMENTS

| | | | | |
|---|---|---|---|---|
| 3,279,360 | A | 10/1966 | Smith et al. | 101/40 |
| 3,563,170 | A | 2/1971 | Cvacho et al. | 101/40 |
| 3,613,571 | A | 10/1971 | Russell et al. | 101/40 |
| 3,665,853 | A | 5/1972 | Hartmeister et al. | 101/247 |
| 3,822,639 | A | 7/1974 | Szpitalak | 101/40 |
| 3,851,579 | A | 12/1974 | Zurick | 101/39 |
| 3,889,630 | A | 6/1975 | Szpitalak | 118/46 |
| 3,996,851 | A | 12/1976 | Urban | 101/40 |
| 4,037,530 | A | 7/1977 | Sirvet | 101/40 |
| 4,140,053 | A | 2/1979 | Skrypek et al. | 101/40 |
| 4,498,387 | A | 2/1985 | Sirbis | 101/40 |
| 4,693,178 | A | 9/1987 | Hudec | 101/40 |
| 4,750,420 | A | 6/1988 | Shriver | 101/40 |
| 4,773,326 | A | 9/1988 | Hudec | 101/40 |
| 5,148,742 | A | 9/1992 | Stirbis et al. | 101/40 |
| 6,167,805 | B1 * | 1/2001 | Williams et al. | 101/40 |

* cited by examiner

*Primary Examiner*—Leslie J. Evanisko
(74) *Attorney, Agent, or Firm*—Mitchell D. Bittman; Robert C. Faber

(57) ABSTRACT

An automated can decorating apparatus including a mechanical mandrel trip mechanism. The mechanical mandrel trip mechanism includes a trip lever mechanism having a trip cam follower disposed on an end of a trip arm which causes the movement of an associated mandrel away from a printing position, and a reset cam follower disposed on a reset arm which causes the mandrel to return to a printing position. Trip cam follower and reset cam follower engage cam surfaces on a trip cam plate and a reset cam plate, respectively, to cause the movement of their associated mandrel.

18 Claims, 16 Drawing Sheets

AUTOMATED CAN DECORATING APPARATUS HAVING MECHANICAL MANDREL TRIP

BACKGROUND OF THE INVENTION

The present invention relates to an automated can decorating apparatus and more particularly to an automated can decorating apparatus that includes a skip-printing mechanism that selectively inhibits or disables the printing of decoration when necessary.

Automated can decorating apparatus having skip-printing mechanisms are well known. The can decorating apparatus includes a mandrel wheel having a plurality of equal-angularly spaced mandrels disposed around its periphery. Each mandrel receives a blank can which is to have decorative features printed on it when the can comes into contact with a printing portion of a blanket wheel as the mandrel wheel is rotated about its axis of rotation. Occasionally, during the automated can decorating process, no blank can is placed on a mandrel or is misplaced on the mandrel. It is desirable to prevent the misplaced can or the empty mandrel from making contact with the blanket wheel to avoid production of a misprinted can, which must be discarded, and/or damage to the empty mandrel.

To overcome this problem many skip-printing mechanism have been proposed. For example, U.S. Pat. No. 3,851,579 to Zurich discloses an automated can decorating apparatus having a skip-print mechanism which moves an individual mandrel away from a printing position to prevent contact with the printing portion of the blanket wheel, when it is detected that the mandrel does not have a can placed on it or has a can misplaced on it, and which then returns the mandrel to a position where it may cause a blank can that is disposed on the mandrel to make contact with the blanket wheel.

U.S. Pat. No. 4,140,053 to Skrypek et al. discloses a skip-printing mechanism which includes an eccentric sleeve having a bore that receives an end of an eccentric shaft and a mandrel that is mounted on the other end of the eccentric shaft. An eccentric sleeve is connected to a power cylinder through a crank arm that extends radially from the eccentric sleeve. Actuation of the power cylinder twists the eccentric shaft which moves the mandrel toward and away from the blanket wheel.

U.S. Pat. No. 4,750,420 to Shriver and U.S. Pat. No. 4,037,530 to Sirvet both disclose skip-printing mechanisms in which the mandrel is mounted on a mandrel holder that is pivoted about a pivoting pin. The axes of the mandrel and the pivoting pin in these mechanisms are parallel but do not coincide. Therefore, the pivoting of the pivoting pin selectively places the mandrel in or out of a contact position. The mandrel holder is pivoted by an arm that is attached to the pivoting pin. The arm is urged at one end thereof to cause the pivoting motion of the mandrel.

U.S. Pat. No. 3,665,853 to Hartmeister, et al. and U.S. Pat. No. 5,148,742 to Stirbis, et al. both disclose skip-print mechanisms in which the printing portion of a blanket wheel can be moved into and out of a contact position with a can on a mandrel. Skip-printing is effected by keeping the printing portion away from a mandrel when it is detected that there is no can on the mandrel or that the can is improperly positioned on the mandrel.

U.S. Pat. No. 4,498,387 to Stirbis, U.S. Pat. No. 4,693,178 to Hudec and U.S. Pat. No. 4,773,326 to Hudec disclose skip-printing mechanisms in which a cam follower on a mandrel holder follows a track. When a can is properly placed on the mandrel, the mandrel holder is directed along a track along which the can makes contact with the printing portion of the blanket wheel. If a can is improperly placed on the mandrel or no can is present, the mandrel holder is directed along a path which will prevent the mandrel contacting the printing portion of the blanket wheel.

U.S. Pat. No. 3,822,639 to Szpitalak and U.S. Pat. No. 3,889,630 to Szpitalak both disclose systems which include a conveyor chain with special links on which mandrels are mounted. A cam can engage a special link to cause the radial movement of the mandrel away from the blanket wheel to effect skip-printing, i.e. to inhibit or disable printing.

U.S. Pat. No. 3,563,170 to Cvacho discloses a skip-printing mechanism in which a mandrel is directed along a path that prevents contact between the mandrel and the printing portion of the blanket wheel when a cam follower, which is attached to the mandrel, engages a camming surface on a cam. The cam is pivotally mounted by a pivot pin, and is pivoted in position to make contact with the cam follower by an actuator.

U.S. Pat. No. 3,279,360 to Smith et al. discloses a can printing machine in which a cam roller urges a mandrel, on which a blank can is placed, against the printing portion of a blanket wheel. The cam roller is itself urged by its engagement with the surface of a cam. To effect skip-printing, the cam is prevented from making contact with the cam roller. As a result, the mandrel is not moved to a position where it may cause a can that is placed on the mandrel to make contact with printing portion of the blanket wheel.

U.S. Pat. No. 3,996,851 to Urban discloses a can printing machine in which a mandrel cam follower engages a mandrel cam to move the mandrel radially toward the printing portion of a blanket wheel to effect printing. To prevent printing, a locking mechanism prevents the cam follower from engaging the cam and thus prevents the mandrel from being radially moved toward the blanket wheel.

U.S. Pat. No. 3,613,571 to Russel et al. shows a mandrel which is mounted at the end of an arm. To effect skip-printing, the arm is pivoted about a point at its end opposite the end on which the mandrel is mounted, in order to move the mandrel away from the blanket wheel.

SUMMARY OF THE INVENTION

It is an object of the present invention to provide an automated can decorating apparatus that includes a skip-printing mechanism for inhibiting or disabling printing by the can decorating apparatus.

According to the present invention, mandrel subassemblies having a mechanical mandrel trip are incorporated in an automated can decorating apparatus, which includes a mandrel wheel and a blanket wheel. Each mandrel subassembly is mounted to the periphery of the mandrel wheel. Each mandrel on the mandrel wheel receives a blank can in a conventional manner. To print on the can, the can on the mandrel is pressed against the printing portion of the blanket wheel as the mandrel wheel and blanket wheel rotate in a conventional manner. When it becomes necessary to disable the printing operation, e.g. when a can is missing or not properly positioned on a mandrel, the mechanical mandrel trip moves that mandrel to prevent the can improperly positioned or the uncovered mandrel making contact with the printing portion of the blanket wheel.

An embodiment of the present invention includes a plurality of support arms mounted around the outer circumference of a mandrel wheel. Each support arm has a mandrel shaft support which is in the form of a transverse bore in which a first non-eccentric portion of an eccentric mandrel shaft is rotatably received. A second eccentric portion of each eccentric mandrel shaft has a mandrel rotatably received on its outer surface and the second portion thus serves as a mandrel seat. The second portion of each eccentric mandrel shaft has a central axis which is offset from the central axis of the first portion of the eccentric mandrel shaft.

A trip lever member is attached to a stub portion of the first portion of the eccentric mandrel shaft, and the stub shaft extends outwardly from the transverse bore in the arm. Movement of the trip lever member rotates the eccentric mandrel shaft about the central axis of the first portion of the eccentric mandrel shaft, thereby causing the second portion, i.e. the mandrel seat, to rotate eccentrically about the central axis of the first portion. Thus, rotation of the first portion of the eccentric mandrel shaft in one direction moves the uncovered mandrel or the blank can that is not to be printed, which is on the second portion of that shaft, to move along a path having a radial component toward the center of the mandrel wheel, away from the blanket wheel. Rotation of the first portion of the eccentric shaft in the opposite direction moves the mandrel carrying a correctly positioned can along a path having a radial component radially out from the center of the mandrel wheel to a position where the blank can that is on the mandrel can contact the printing portion of the blanket wheel.

The trip lever member includes a trip arm and a reset arm which are angularly spaced from one another around the eccentric shaft and are connected to the first portion of the eccentric shaft by a sleeve member. The trip arm has a trip cam follower disposed on it and the reset arm has a reset cam follower disposed on it. A moveable trip plate is selectively moved to engage a selected one of the trip cam followers. The engagement of a trip cam follower on the trip arm of a trip lever with the trip cam plate rotates the eccentric mandrel shaft to which the trip lever is attached in one direction to move the mandrel that is mounted on the second portion of the eccentric mandrel shaft on a path with a radial component toward the center of the mandrel wheel and away from the blanket wheel.

A reset cam plate is positioned to engage the reset cam follower on a trip lever member that had been moved due to engagement with the trip cam plate. The engagement of a reset cam follower and the reset cam plate causes the trip lever to rotate its associated mandrel away from the center of the mandrel wheel on a path with a radial component and to a position where a blank can on the mandrel may contact the printing portion of the blanket wheel.

An over-center spring holds an associated mandrel against the printing portion in the print position and also urges the mandrel toward a non-print position where the mandrel is spaced away from the printing portion of the blanket wheel.

According to an embodiment of the invention, there are two moveable trip cam plates, each capable of only engaging one respective group of the trip cam followers. Each trip cam plate is moved into a position to contact a trip cam follower by the actuation of a respective air-actuated piston arm.

Other features and advantages of the present invention will become apparent from the following description of the invention which refers to the accompanying drawings.

DETAILED DESCRIPTION OF A PREFERRED EMBODIMENT

Figure 1:
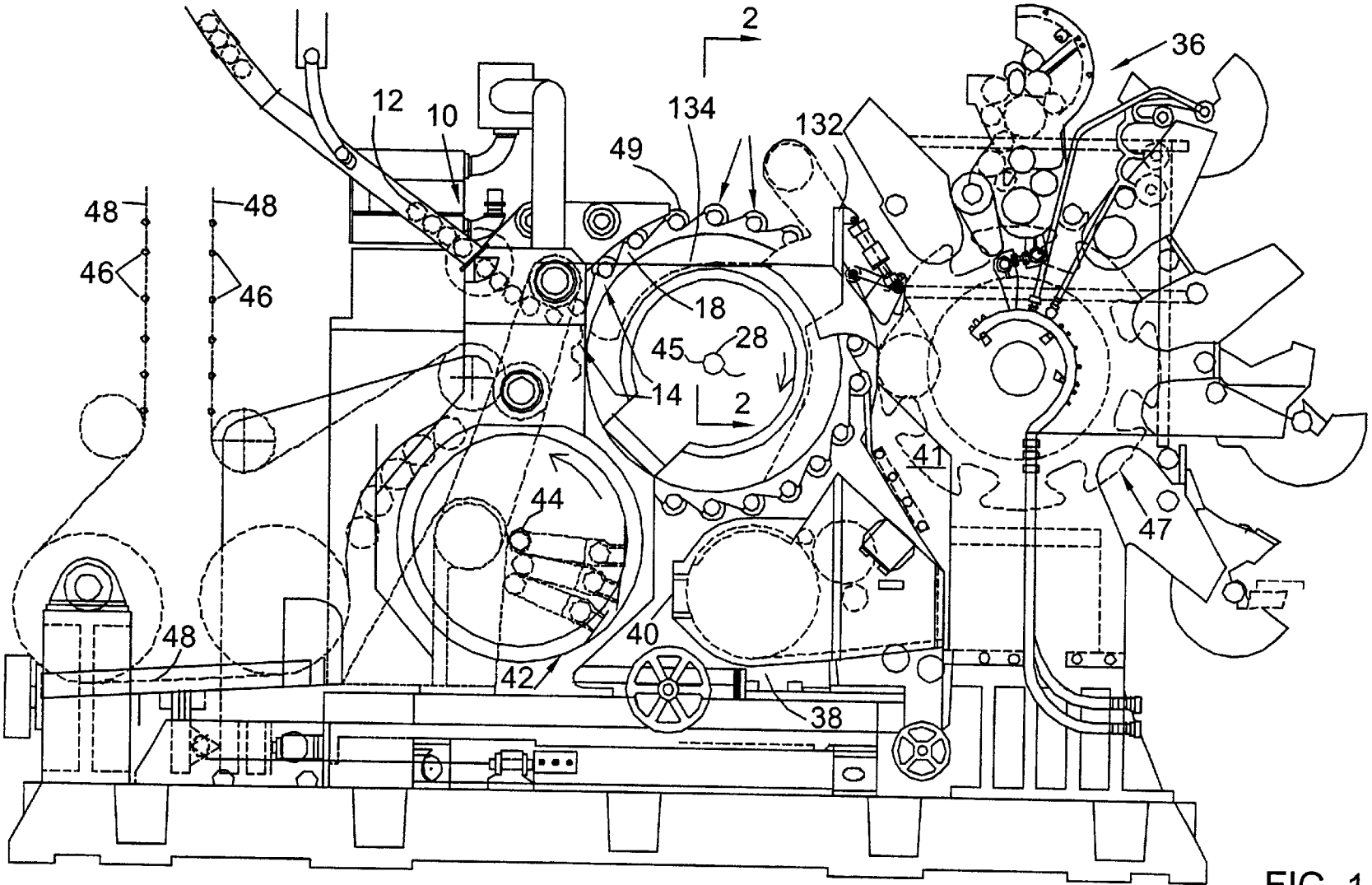
FIG. 1 shows an automated can decorating apparatus according to an embodiment of the present invention.

FIG. 1 shows an embodiment of an automated can decorating apparatus in which the present invention may be installed. The apparatus includes infeed conveyor chute 10 which receives undecorated blank cans 12 from a can supply (not shown) and places them in arcuate cradles 14, which are aligned depressions on the outer edges of spaced segmented rings 16, 18, shown in FIGS. 2 and 3.

Figure 2:
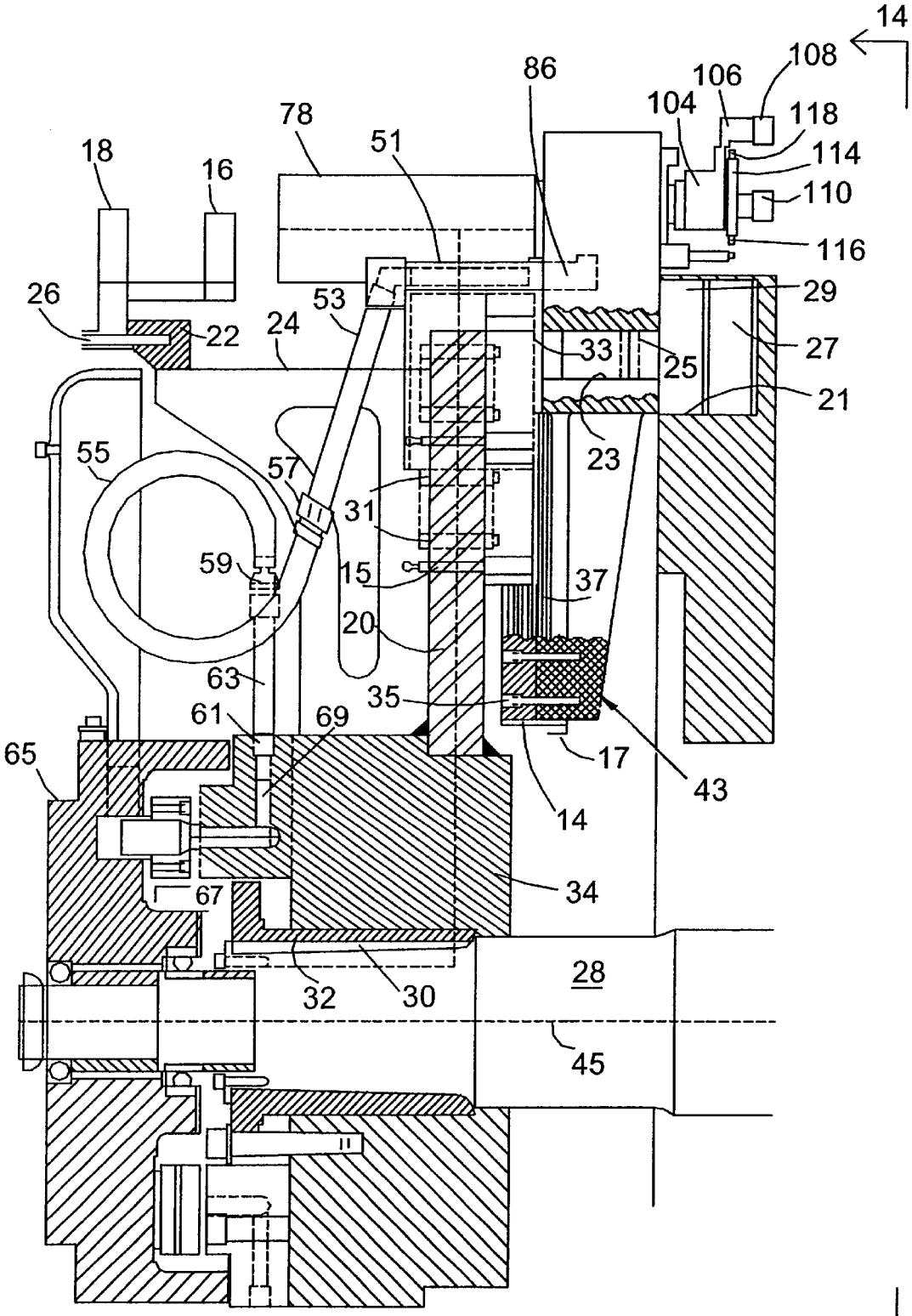
FIG. 2 shows a fragmentary cross-section of the mandrel carrier assembly along line 2—2 of FIG. 1 and looking in the direction of the arrows 2—2.
Figure 3:
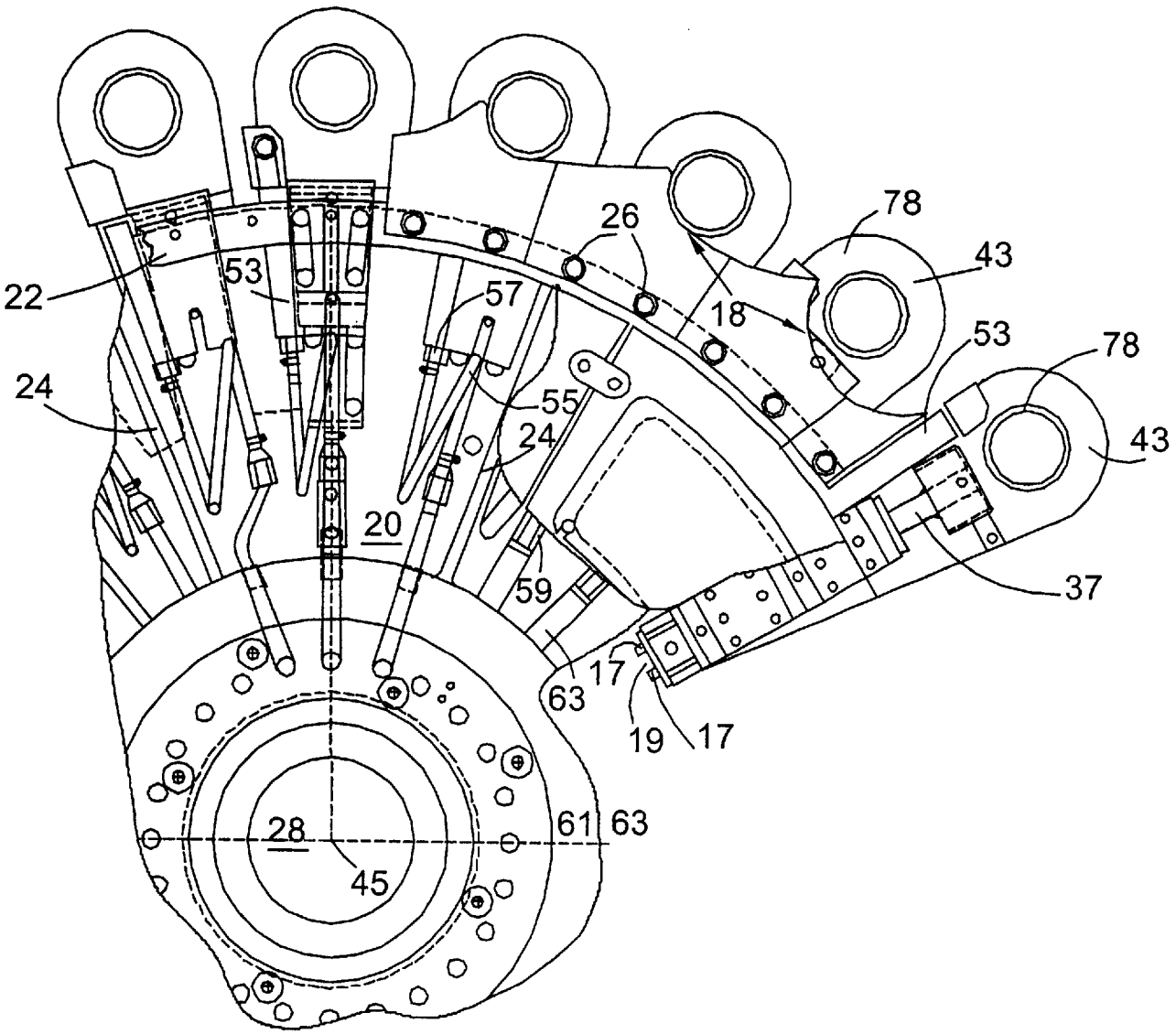
FIG. 3 is a fragmentary front elevation of the mandrel carrier assembly looking in the direction of arrows 3—3 of FIG. 2.

Referring to FIGS. 2 and 3, spaced segmented rings 16, 18 are secured to mandrel wheel 20 by support ring 22 which is positioned in front of and secured to mandrel wheel 20 by eight angularly spaced standoffs 24. Segments of pocket rings 16, 18 are secured to supporting ring 22 by screws 26.

Mandrel wheel 20 is mounted on and rotates about the axis of drive shaft 28. Drive shaft 28 is oriented horizontally and is rotatably supported on a fixed portion of the frame of the apparatus in FIG. 1. Mandrel wheel 20 and shaft 28 are connected by key 30 which engages tapered sleeve 32 that is disposed between shaft 28 and hub 34. Hub 34 is welded to mandrel wheel 20.

Mandrels 78 are mounted to mandrel wheel 20 by a mandrel subassembly (described below). Each mandrel 78 is oriented horizontally and is axially aligned with an arcuate cradle 14, while the mandrel passes through a loading region downstream from infeed conveyor 10. In the loading region, a deflector (not shown) moves a blank can 12 horizontally and rearwardly to transfer the can from its cradle 14 to a mandrel 78. Then, suction activated by an air vacuum system (not shown) through an axial passage (described later) in a mandrel 78 draws a can 12 to be seated on a mandrel 78.

Referring to FIG. 1, while a can is seated on a mandrel 78, surface decorations are imparted to the blank can 12 by bringing it into engagement with a rotating image transfer printing press 36, including bringing the can into contact with a printing portion 47 of a continuously rotating blanket wheel 41. After it is decorated, and while it is seated on the mandrel, the decorated can is coated with a protective film of varnish applied by applicator roll 38 in varnish unit 40. Cans 12 are then transferred from mandrels 78 to suction cups (not shown) mounted at the periphery of transfer wheel 42 while transfer wheel 42 rotates about shaft 44. Thereafter, cans 12 are deposited on horizontal pins 46 which project from output conveyor 48. The cans 12 are then carried through a curing oven (not shown) by output conveyor 48. This results in the automatic printing of images on blank cans 12.

Occasionally, a blank can 12 is either not at all placed on a mandrel 78 or is improperly placed. This would cause either a misprinted can, which would be discarded, or the printing of images on the uncovered mandrel, which is undesirable.

A sensor or detector 49 shown in FIG. 1 detects whether a mandrel 78 (FIG. 2) is uncovered or a can is improperly positioned on the mandrel. That mandrel is to be moved to a "non-print" position relative to printing portion 47 of the blanket wheel 41. Thus, as that mandrel 78 (FIG. 2) rotates past the blanket wheel 41, it remains spaced from that wheel. Thereafter, mandrel 78 is returned to a position where it may once again receive a blank can 12. The movement of a mandrel 78 from a print position to a non-print position and vice versa is achieved by a mechanical mandrel trip mechanism (described below) which allows for the selective movement of a mandrel 78 away from a print position when sensor 49 detects that a can has not been placed on or has been misplaced on that mandrel.

Figure 4:
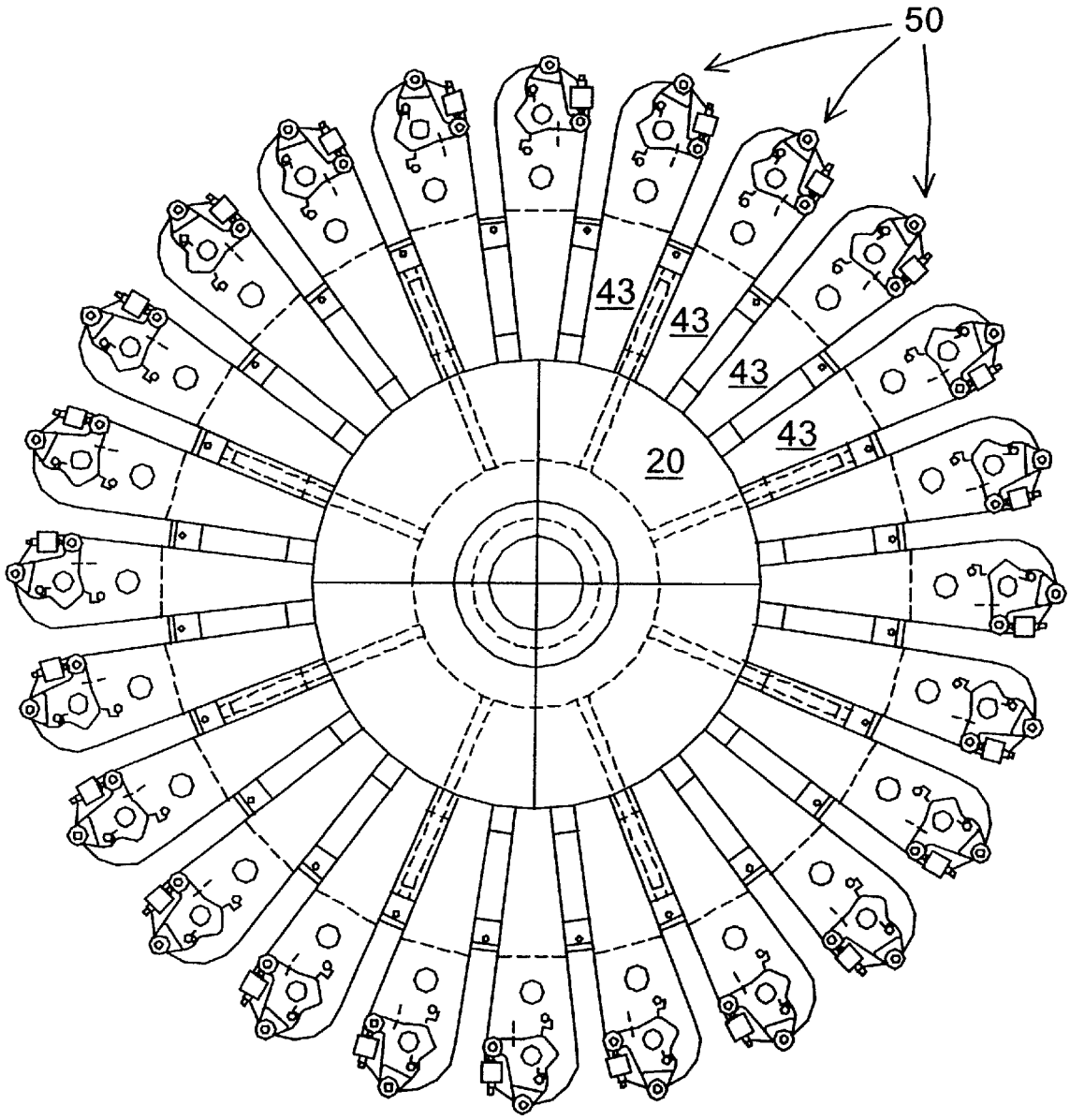
FIG. 4 is a front view of a mandrel carrier assembly according to an aspect of the present invention.

FIG. 2 shows a mandrel 78 assembled onto mandrel wheel 20. According to a preferred embodiment mandrel wheel 20 is a steel disk having a central axis 45. Referring to FIG. 4, mandrel wheel 20 carries a plurality, preferably twenty four, of mandrel subassemblies 50. Mandrel subassemblies 50 are uniformly circumferentially spaced around mandrel wheel 20. In FIG. 3, each mandrel subassembly 50 includes a support arm 43 that is mounted to a position at the outer circumference of mandrel wheel 20.

Figure 5:
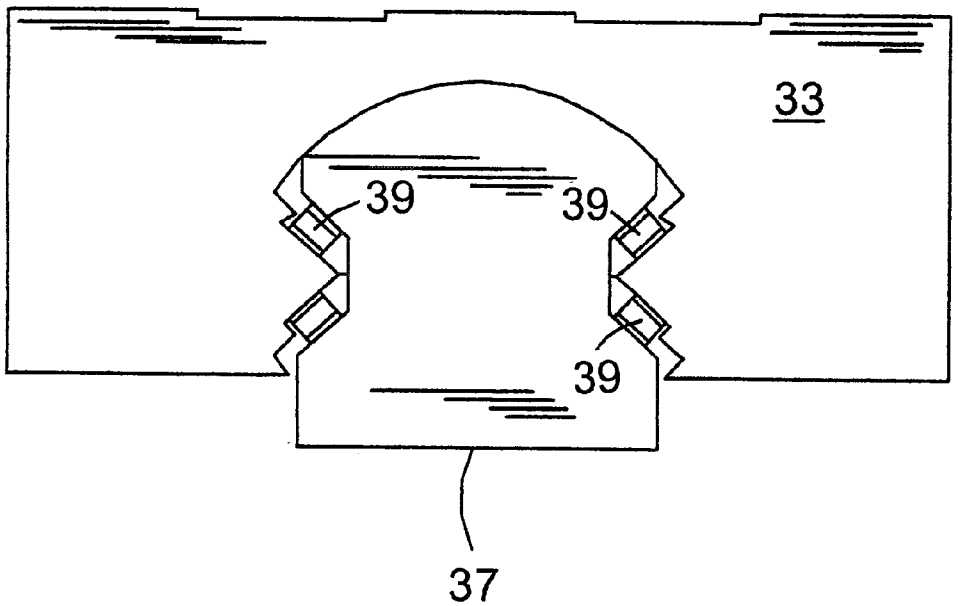
FIG. 5 is a schematic end view of a monorail engaged with the rollers of a linear slide.

Referring to FIGS. 2 and 3, a monorail 37 is mounted to a surface of support arm 43 by screws 35 and extends along a radial direction with respect to the center of mandrel wheel 20. A pair of slides 33, which are mounted to mandrel wheel 20 by screws 31 engage monorail 37. Slides 33 include aligned cylindrical roller-type bearing units 39 (FIG. 5) which through cooperation with monorail 37 allow each mandrel subassembly 50 to reciprocate radially with respect to central axis 45 of mandrel wheel 20.

A pair of followers 29, 27 are rotatably mounted on a surface of support arm 43 opposing the surface on which monorail 37 is mounted. The followers are mounted by a stub shaft 25 which projects from an aperture 23 in support arm 43. Followers 29, 27 are received by and follow a closed loop cam track (or master cam) 21. Closed loop cam track 21 guides the mandrel subassemblies 50 along a printing path, as is shown schematically by FIGS. 13 and 14.

A retainer 19 is secured to the radially inner end of each arm 43 to prevent separation between rail 37 of mandrel subassembly 50 and slides 33. Screws 17 secure retainer 19 in its operative position at the radially inner end of rail 37. Aperture 15 allows the entry of lubricants to lubricate the bearing elements 34 (FIG. 5) of slides 33, 33. The structure of support arm 43 and its assembly onto mandrel wheel 20 are disclosed in detail in U.S. Pat. No. 6,167,805. The disclosure of that patent is hereby incorporated by reference.

Figure 6:
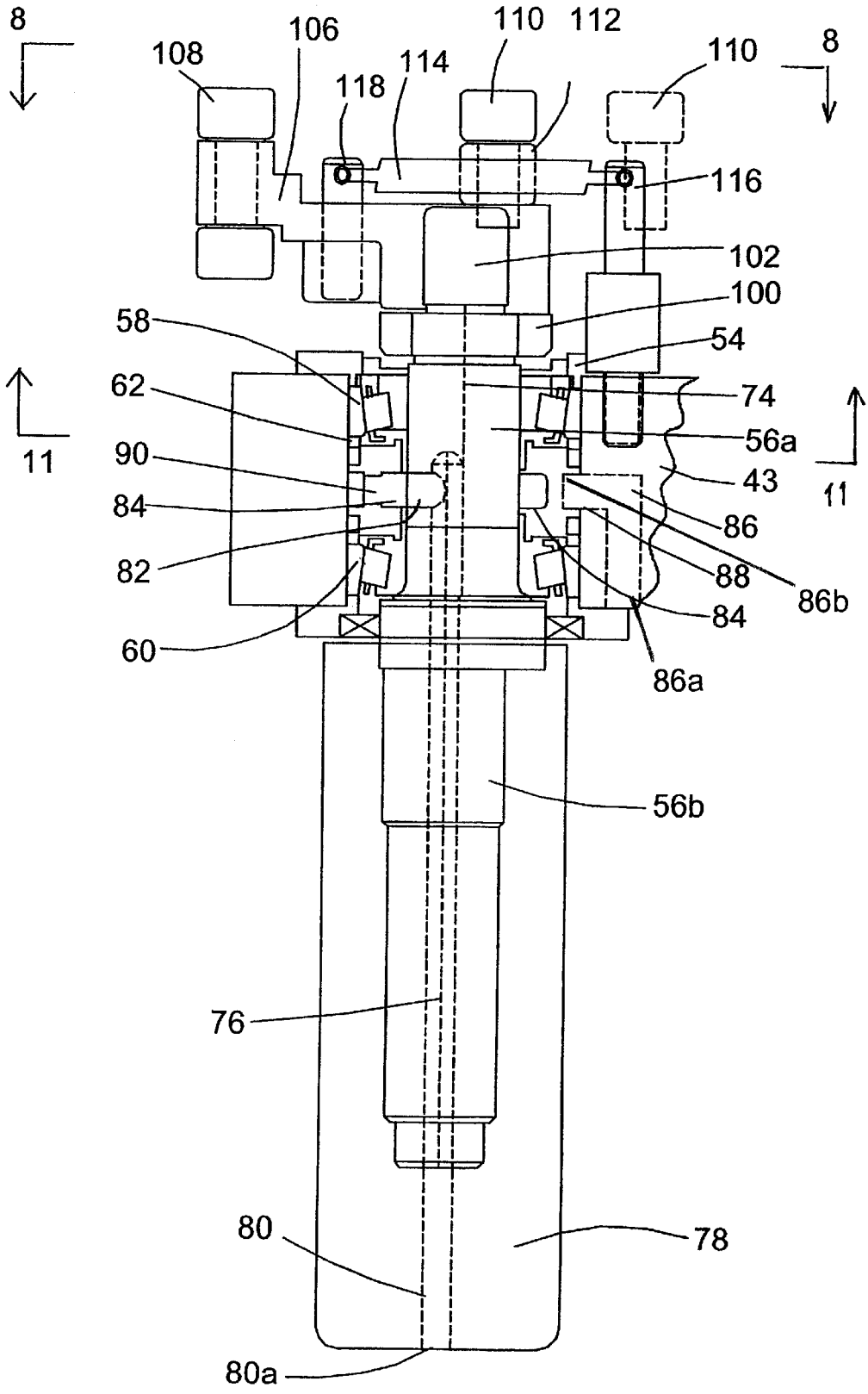
FIG. 6 is a fragmentary side view of a mandrel subassembly according to the present invention.

Each mandrel 78 is connected to an air and vacuum system (not shown) which is employed to selectively eject or to retain a can 12 on the outer surface of a mandrel 78. Pressurized air or vacuum are selectively applied through an air channel 80 (FIG. 6) that extends through a portion of mandrel shaft 56 (FIG. 7) and terminates at an opening 82 (FIG. 6) which is disposed at the side of the mandrel shaft 56 (FIG. 6). Air is sucked through the opening to create a vacuum in order to retain a can 12 on mandrel 78, or air is flushed through the opening to eject a can 12 that is disposed on mandrel 78.

Referring to FIG. 2, the air channel 80 (FIG. 6) communicates with the air and vacuum system through stub pipes 51, 53 which are attached to a first end of flexible hose 55 by fitting 57. The other end of flexible hose 55 is provided with fitting 59. Fitting 59 connects flexible pipe 55 to hub attachment 61 via rigid stub pipe 63. Application of pressurized air and vacuum to hose 55 is under the control of a face-valve arrangement that includes stationary valve elements 65 and which is mounted on a stationary frame (not shown) and rotating wear plate 67 having apertures aligned with one end of channels 69 in hub attachment 61. The movable face-valve arrangement is connected to hub 34 for continuous rotation therewith.

Figure 7:
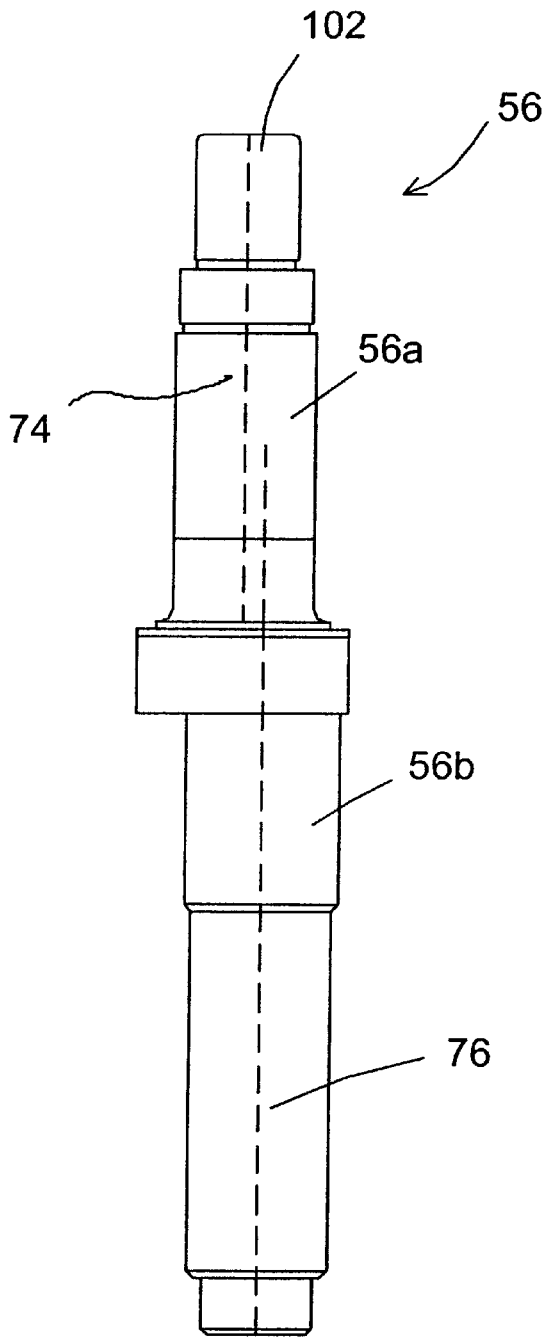
FIG. 7 shows an eccentric mandrel shaft.

Referring to FIGS. 6 and 7, a mandrel subassembly 50 which includes a mechanical mandrel trip mechanism according to an embodiment of the invention is described. Mandrel subassembly 50 includes a support arm 43 which is mounted on mandrel wheel 20 as previously described. Support arm 43 includes bore 54 therethrough. The central axis of bore 54 is preferably parallel to the central axis 45 of mandrel wheel 20. Consequently, a mandrel 78 mounted to a support arm 43 will extend parallel to central axis 45 (FIG. 2) of mandrel wheel 20. Bore 54 is large enough to receive first tapered roller bearing 58 and second tapered roller bearing 60, which are tapered in opposite directions to oppose oppositely directed forces and are separated by an annular divider 62. The respective inner rings of first roller bearing 58 and second roller bearing 60 and the aperture in annular divider 62 are aligned axially and are large enough to snugly fit around the outer surface of a first portion **56*a* (FIG. 7) of mandrel shaft 56. First tapered roller bearing 58, second tapered roller bearing 60 and annular divider 62 fit inside bore 54, and thus allow first portion 56*a* (FIG. 7) of mandrel shaft 56 to be rotatably installed on support arm 43. This arrangement is sealed inside bore 54** to prevent the lubricants on the bearings from becoming contaminated with dust and other undesirable substances.

First portion **56*a* of mandrel shaft 56 has a rotation axis 74 about which it is rotated inside bore 54. First portion 56*a* of mandrel shaft 56 cooperates with an eccentric second portion 56*b* of the shaft 56 which serves as a mandrel seat and is integrally attached and preferably forms a unitary body with first portion 56*a* of mandrel shaft 56. Central axis 76 of eccentric second portion 56*b* of mandrel shaft 56 is offset from axis 74 of first portion 56*a* of mandrel shaft 56 so that eccentric second portion 56*b* revolves about axis 74 of mandrel shaft 56 upon rotation thereof about axis 74**.

Mandrel 78 is rotatably mounted on eccentric second portion 56*b* of mandrel shaft 56. Air channel 80 extends from an air opening 80*a* in mandrel 78 to an air opening 82 on the side of mandrel shaft 56. Air opening 82 on the side of mandrel shaft 56 opens to an annular groove 84 formed in annular divider 62. Annular groove 84 is in communication with the air and vacuum system through an air portal 86 inside support arm 43 as shown in FIG. 4. Specifically, air portal 86 has an opening 86*a* which is connected to stub pipe 51 (FIG. 2) and an opening 86*b* on the surface of bore 54 which opens to an annular exterior groove 88 on the exterior surface of annular divider 62. An aperture 90 connects the exterior groove 88 on the exterior surface of annular divider 62 to its interior annular groove 84, whereby air can be transmitted from the air and vacuum system to air channel 80 to selectively eject or retain a can 12 on mandrel 78 by manipulation of air pressure.

Exterior annular groove 88 on the exterior surface of annular divider 62 is hermetically sealed in order to seal the air passages against intrusion of lubricants from tapered roller bearings 58, 60. Lock nut 100 having a bearing surface in the axially interior facing surface thereof secures first portion 56*a* of mandrel shaft 56 to support arm 43. A stub portion 102 of first portion 56*a* of mandrel shaft 56 extends out of lock nut 100.

Figure 8:
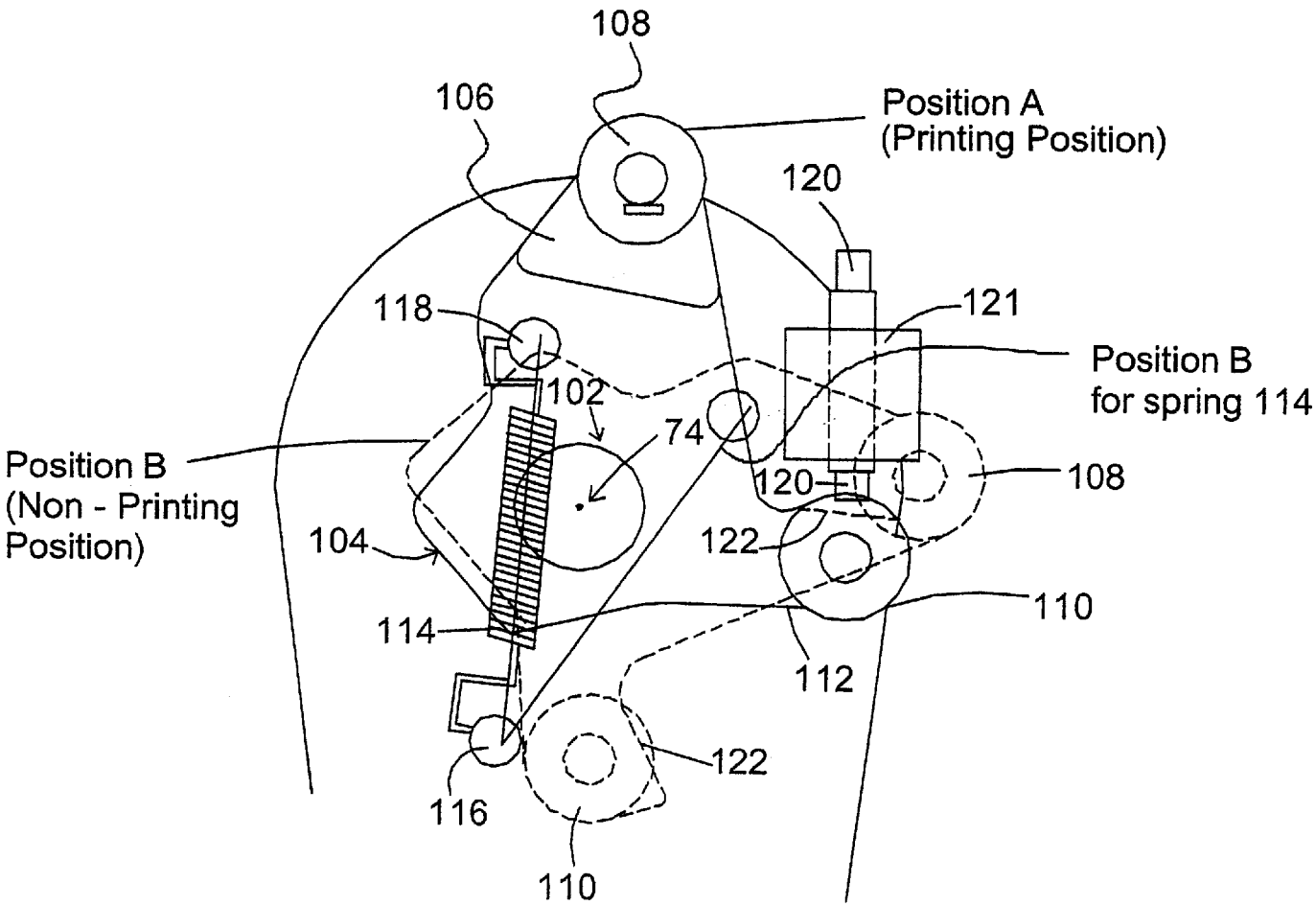
FIG. 8 is a rear view of a portion of a mandrel subassembly according to the present invention looking in the direction of arrows 8—8 of FIG. 6.
Figure 9:
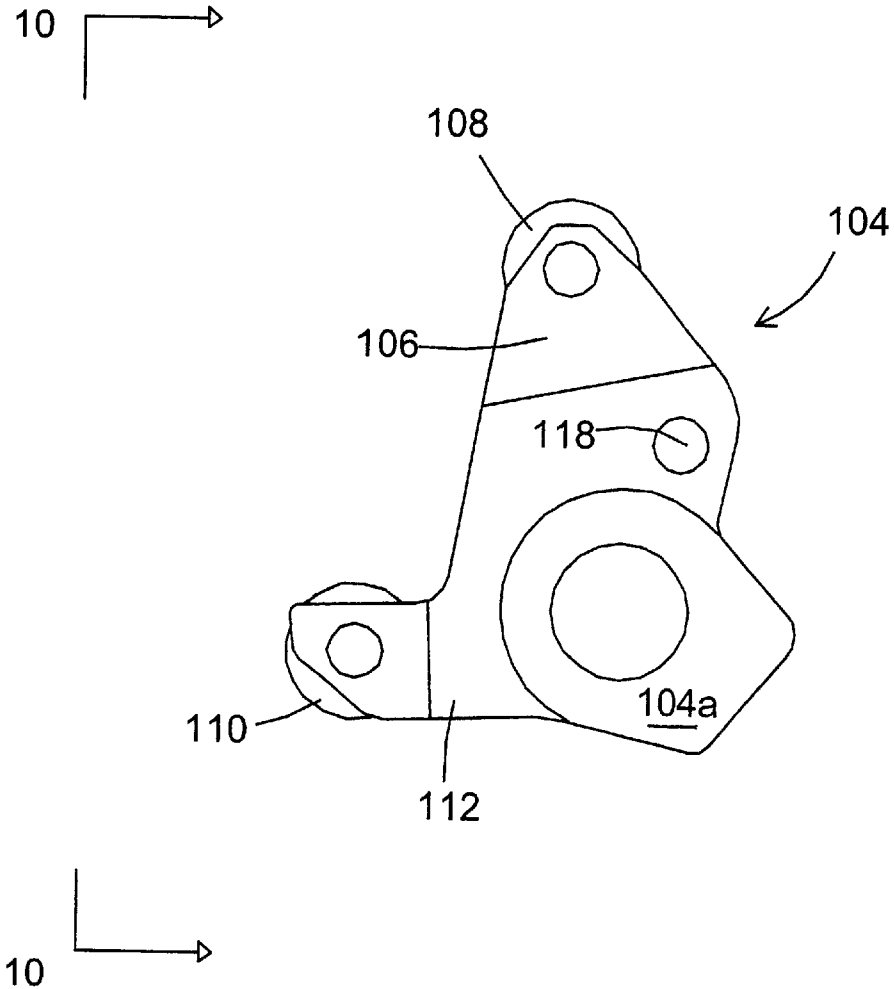
FIG. 9 shows a view of a trip lever of the present invention viewed toward sleeve member of the trip lever.
Figure 10:
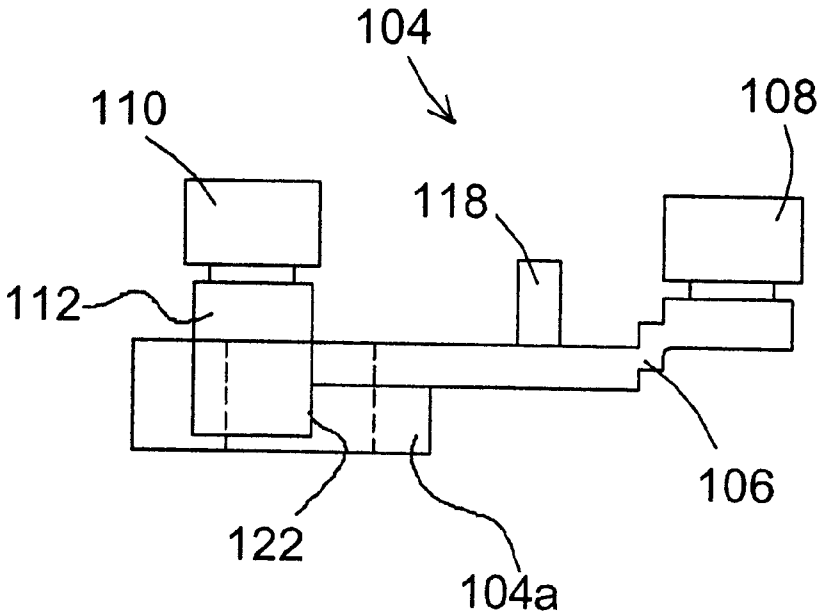
FIG. 10 is a side view of the trip lever in the direction of arrows 10—10 in FIG. 9.

Referring to FIGS. 8, 9 and 10, trip lever 104, which is secured to stub portion 102 of mandrel shaft 56, includes trip arm 106 and reset arm 112 and a sleeve 104*a* that fits onto the outer surface of stub portion 102. Preferably, trip arm 106, reset arm 112, and sleeve 104*a* form a unitary body. Trip arm 106 extends radially away from stub portion 102. Trip cam follower 108 is disposed at a distal position on trip arm 106.

Reset arm 112, which is angularly spaced from trip arm 106, also radially extends away from axis 74 of stub portion 102. Reset cam follower 110 is disposed on reset arm 112.

Referring to FIG. 8, over-center spring 114 is secured at its ends to and extends between first spring post 116, which is mounted on support arm 43, and second spring post 118, which is mounted on trip lever 104.

Figure 11:
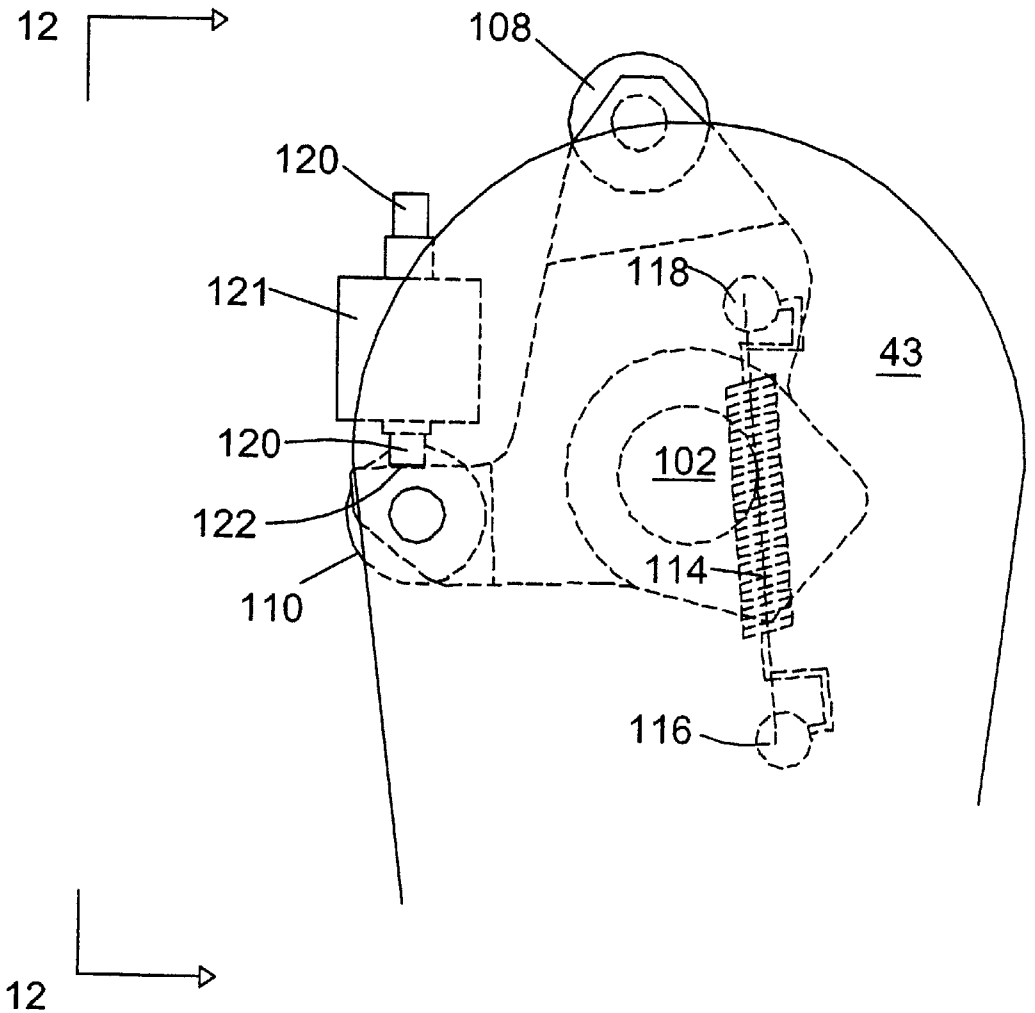
FIG. 11 is a view of the mandrel subassembly according to the present invention in the direction of arrows 11—11 in FIG. 6.
Figure 12:
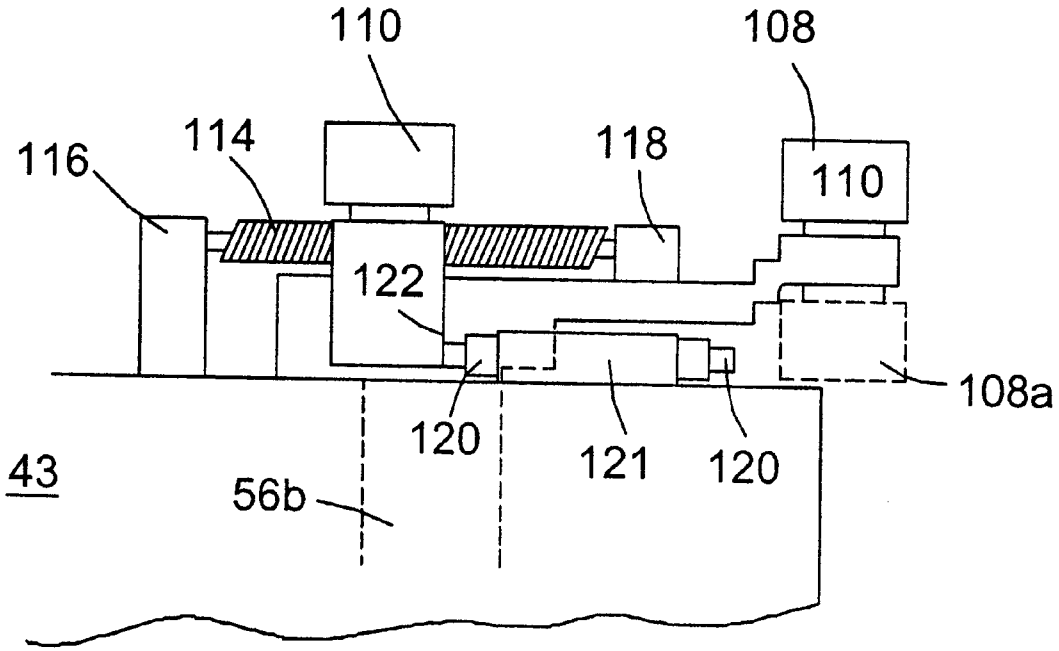
FIG. 12 is a fragmentary view of the mandrel subassembly in the direction of arrows 12—12 in FIG. 11.

Referring to FIGS. 8, 11 and 12, when trip lever 104 is in print position where a can disposed on its associated mandrel may make contact with printing portion 47 of the blanket wheel 41 (position A as shown by solid lines), adjustment member 120, which may be an adjustable length bolt disposed in a screw post 121 on arm 43, abuts against wall 122 as spring 114 pulls against spring post 118. Wall 122 is positioned below the plane on which reset cam follower 110 is disposed, and is preferably integral with reset arm 112.

When adjustment member 120 is moved away from wall 122, trip lever 104 twists stub portion 102 in a counter-clockwise direction in FIG. 8. In turn, the mandrel that is disposed on second portion 56*b* of mandrel shaft 56 is brought closer to the printing portion 47 of the mandrel wheel. When adjustment member 120 is moved toward wall 122, trip lever 104 twists stub portion 102 in a clockwise direction, which moves the mandrel disposed on second portion 56*b* of mandrel shaft 56 farther away from the mandrel wheel. Therefore, adjustment member 120 and wall 122 serve to set their associated mandrel in a perfect radial position relative to the other mandrels, and relative to the mandrel wheel.

When spring 114 is in the print position A, force is exerted by spring 114 onto stub portion 102, thereby twisting first portion 56*a* of mandrel shaft 56 in a counter-clockwise direction in FIG. 8. The twisting action of first portion 56*a* of mandrel shaft 56 also causes its eccentric second portion 56*b* to press its associated mandrel 78 against the printing portion 47 of the blanket wheel 41, which in turn results in the printing of images on a blank can that is disposed on mandrel 78. Thus, when spring 114 is in its print position, mandrel 78 is in a printing position which allows the printing operation to take place.

When trip lever 104 is rotated to a non-print position (position B shown by broken lines in FIG. 8), trip lever 104 twists stub portion 102 clockwise, causing eccentric second portion 56*b* of mandrel shaft 56 to withdraw its associated mandrel 78 from its printing position (position A). Thus, by twisting stub portion 102, mandrel 78 which is rotatably mounted on eccentric second portion 56*b* of mandrel shaft 56, may be selectively moved from a printing position to a non-print position.

To return mandrel 78 from a non-print position to a printing position, reset cam follower 110 may be moved in a counter-clockwise direction, which causes, the twisting of stub portion 102 in a counter-clockwise direction. Once spring 114 passes over the center position, i.e., axis 74 of mandrel shaft 56, it will pull on spring post 118 until wall 122 abuts adjustment member 120, thereby returning mandrel 78 to the printing position.

The transition between the printing mode and the non-printing positions is now described with reference to FIGS. 13 and 14.

Figure 13:
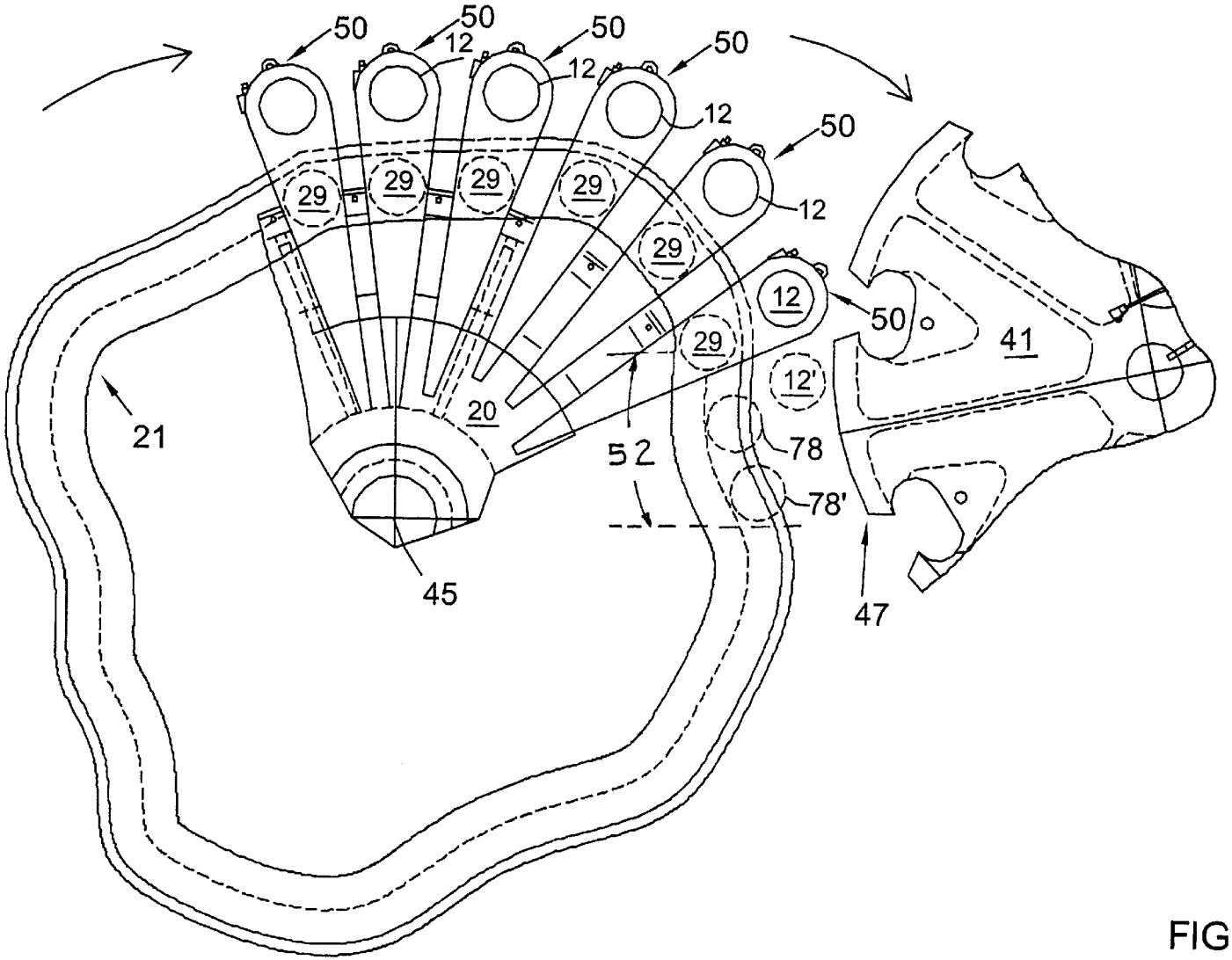
FIG. 13 is a fragmentary front view of the mandrel carrier assembly according to a preferred embodiment of the invention.

FIG. 13 schematically shows several mandrel subassemblies 50 rotatable about central axis 45 of mandrel wheel 20. In the preferred embodiment, mandrel subassemblies 50, which are disposed on mandrel wheel 20, are rotated in a clockwise direction. A blank can 12 may be disposed on mandrel 78 of each subassembly 50. Arms 43 are radially moved toward and away from central axis 45 of mandrel wheel 20 as followers 29, 27 (FIG. 2) follow the path set out by cam track 21. Cam track 21 includes a curved portion 52 which substantially corresponds to the curvature of a printing portion 47 of blanket wheel 41. To effect printing, an arm 43 (not shown) is directed along curved portion 52 causing a blank can 12 which is disposed on its associated mandrel 78 (not shown) to press against printing portion 47 of blanket wheel 41. It should be noted that as arm 43 is moved along curved portion 52, can 12 which is disposed on a mandrel 78 is rotated and thus rolled on printing portion 47 of blanket wheel 41 as shown schematically by FIG. 13. As shown in FIG. 13, when can 12 is moved clockwise about central axis 45 of mandrel wheel 20, it is rotated counter-clockwise about the axis of rotation of mandrel 78 on which it is disposed, and is thus rolled on printing portion 47 of blanket wheel 41. Numeral 12' shows in phantom can 12 in an advanced position where it makes contact with printing portion 47 of blanket wheel 41.

Figure 14:
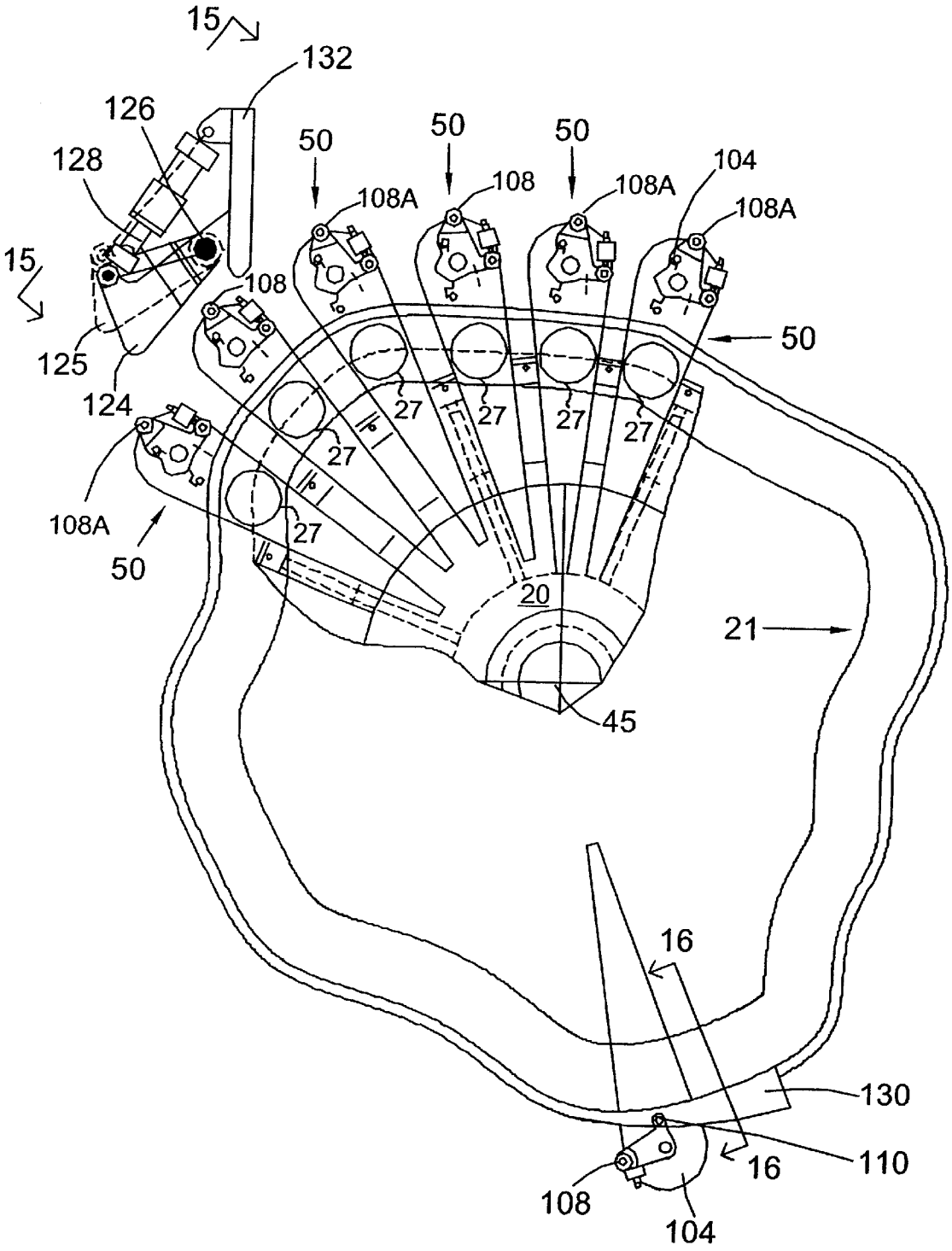
FIG. 14 is a fragmentary rear view of the mandrel carrier assembly in the direction of arrows 14—14 in FIG. 2.
Figure 15:
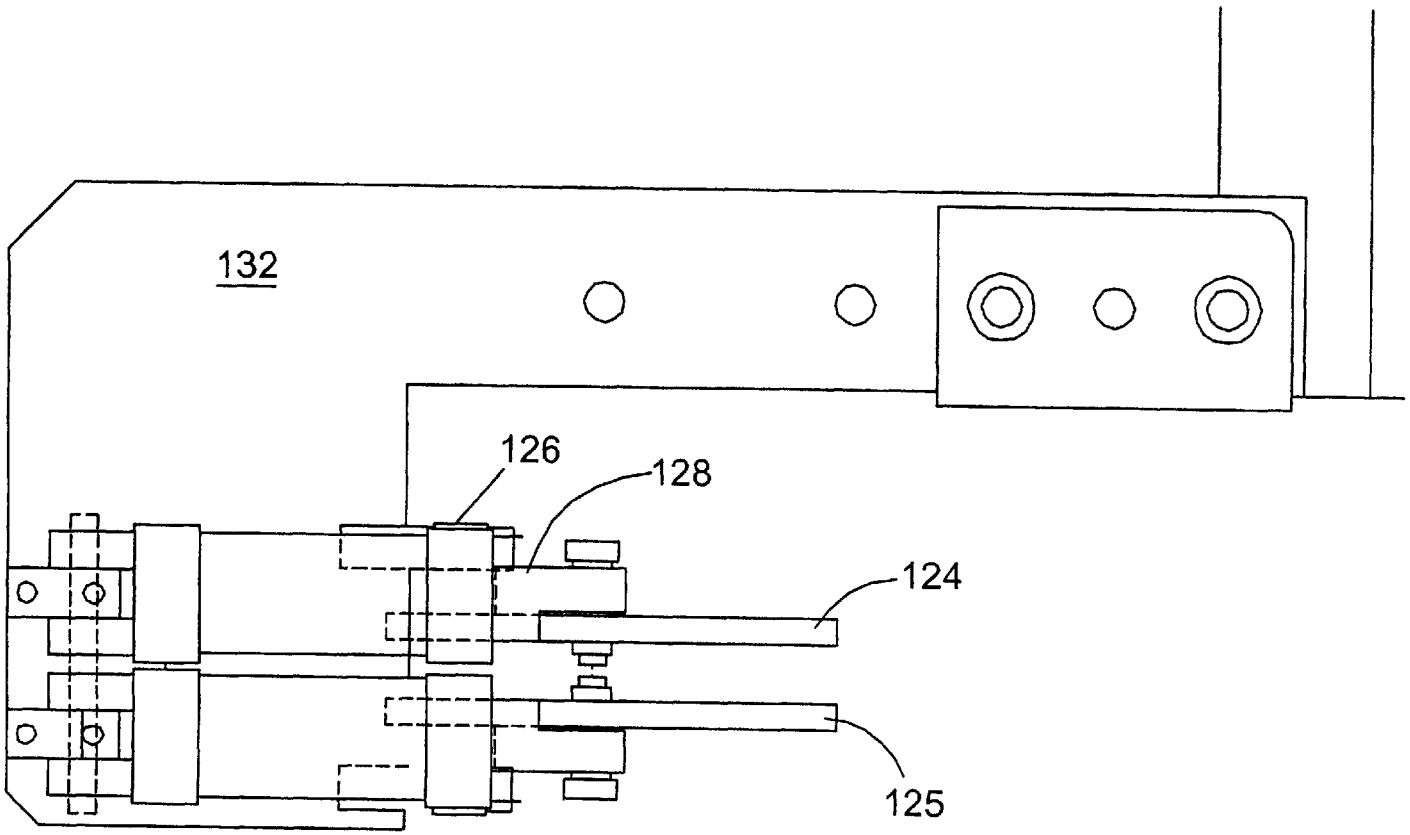
FIG. 15 is a side view of trip cam plate assembly according to an aspect of the present invention looking in the direction of arrows 15—15 in FIG. 14.

Referring now to FIG. 14, first cam plate 124 is set to pivot about pivot pin 126 toward a position where it will make contact with cam followers 108 when an air activated piston 128 moves cam plate 124 in a direction toward mandrel wheel 20 on which mandrel subassemblies 50 are mounted. Air-activated piston 128 is activated in response to a signal from sensor 49 (FIG. 1) in automated can decorating apparatus shown in FIG. 1, indicating that a blank can has not been placed or has been misplaced on a mandrel. The engagement of a trip cam follower 108 with trip cam plate 124 will cause the clockwise rotation of its associated eccentric mandrel shaft 56 associated with the cam follower 108, which will cause the movement of mandrel 78 that is mounted thereon from the print position to the non-print position.

Second cam plate 125 is pivoted about pivot pin 126 when a second air-activated piston (not shown) urges second cam plate 125 toward a position where it may make contact with trip cam followers 108A on mandrel subassemblies 50. First cam plate 124 can contact only one set of trip cam followers 108, while second cam plate 125 can contact only the remaining set of trip cam followers 108A. Trip cam followers 108, 108A on respective mandrel subassemblies 50 are preferably disposed alternately on a position relatively closer (e.g. 108A, FIG. 6) to support arm 43 of their respective mandrel subassemblies 50 and a position relatively further (e.g. 108, FIG. 6) from support arm 43 of their respective subassemblies 50. Thus, cam plate 124 and cam plate 125 only make contact with every other trip cam follower because the trip cam followers 108, 108A are arranged on alternate planes that are spaced apart. This arrangement allows adequate time for withdrawing a cam plate 124, 125 after it has been activated so that it will not accidentally make contact with a trip cam follower 108, 108A on a succeeding mandrel subassembly.

Once trip lever 104 on a mandrel subassembly 50 has been tripped due to contact between its trip cam follower 108 and one of trip cam plates 124, 125, its associated mandrel 78 is moved to a non-print position as described above. In FIG. 13, mandrels 78, 78' are shown in phantom to be in their radially inward tripped positions and thus away from printing portion 47 of blanket wheel 41. If a mandrel 78 is not moved to a non-print position, a can, 12 placed thereon makes contact with printing blanket portion 47 and is rolled on printing blanket portion 47 in order to receive printed images thereon. Can 12' shows position of can 12 further down on printing blanket portion 47. Referring to FIG. 14, once the tripped mandrel has moved past the blanket wheel 41, reset cam follower 110 on the tripped mandrel's associated mandrel subassembly 50 makes contact with the cam surface of stationary reset cam plate 130 (to the bottom in FIG. 14), and is caused to move in the counter-clockwise direction, thereby moving trip lever 104 that is associated with the tripped mandrel 78 from the non-print position (position B, FIG. 8) to the printing position (position A, FIG. 8). Consequently, a tripped mandrel 78 associated with cam follower 110 that makes contact with reset cam plate 130 is moved from its non-print position back to its printing position where it may cause a blank can 12 that is received on its outer surface to make contact with the printing portion 41 of the blanket wheel 41 (FIG. 1).

Figure 16:
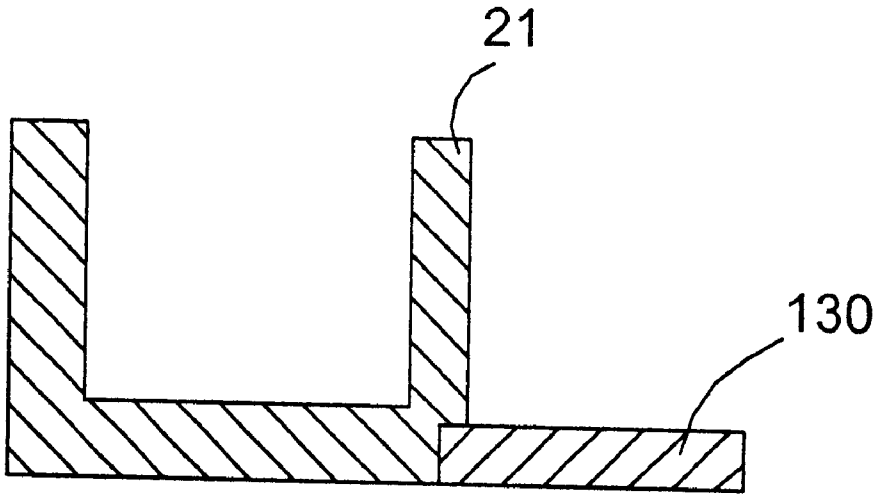
FIG. 16 is a cross-sectional view of the reset cam follower along line 16—16 in FIG. 14 looking in the direction of the arrows showing the attachment of the reset cam follower to the closed loop cam tack of the can printing machine.

In the preferred embodiment, trip cam plates 124, 125 and their respective associated operating piston, e.g. 128, are disposed on an arm 132 which suspends them at an appropriate place in the vicinity of the path of mandrel subassemblies 50. Arm 132 is preferably mounted on main casting 134 of the can decorating apparatus as shown in FIG. 1. Main casting 134 serves as the main support housing for the various elements in the can printing machine. Also, in the preferred embodiment reset cam plate 130 is attached adjacent to closed loop cam track 21 as shown in FIG. 16 in a position where it may come into contact with reset cam follower 110 on a tripped mandrel's associated mandrel subassembly 50 in order to cause the same to move in the counter-clockwise direction, thereby moving trip lever 104 that is associated with the tripped mandrel 78 from the non-print position (position B, FIG. 8) to the printing position (position A, FIG. 8).

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An automated can decorating apparatus comprising:

a mandrel wheel rotatably mounted on a mandrel wheel shaft for rotation about a first central axis thereof;

a blanket wheel having a printing portion that imparts decorations onto an outer surface of a blank can when said outer surface of said blank can is placed in contact with said printing portion;

a plurality of spaced apart mandrel subassemblies each mounted at the periphery of said mandrel wheel, each mandrel subassembly including:

a support member connected to said periphery of said mandrel wheel, said support member including a shaft support having a second central axis parallel to said first central axis of said mandrel wheel shaft;

an eccentric mandrel shaft having an actuating portion rotatably mounted in said shaft support for rotation about said second central axis thereof, said actuating portion including a stub portion extending away and outwardly from said support member, said eccentric mandrel shaft including a mandrel seat attached to said actuating portion, said mandrel seat having a third central axis that is parallel to but offset from said second central axis of said actuating portion and said mandrel seat is disposed outside of said shaft support;

a mandrel for receiving a blank can, said mandrel being mounted on said mandrel seat;

a trip cam follower connected to and eccentric to said stub portion;

a reset cam follower connected to and eccentric to said stub portion and angularly spaced from said trip cam follower; and wherein said automated can decorating apparatus further comprises:

at least one movable trip cam plate having a trip cam surface that urges said trip cam follower in a first direction when said movable trip cam plate is moved to allow said trip cam surface to engage said trip cam follower;

a reset cam plate having a reset cam surface that urges said reset cam follower in a second direction when said reset cam follower and said reset cam surface engage one another;

wherein when said trip cam follower is moved in said first direction, said actuating portion of said eccentric shaft is rotated about said second central axis for causing said mandrel seat to revolve about said second central axis of said actuating portion for causing said mandrel to be moved to a non-print position at which an outer surface of a blank can that is received on said mandrel may not make contact with said printing portion of said blanket wheel; and wherein when said reset cam follower is moved in said second direction, said actuating portion of said eccentric shaft is rotated about said second central axis for causing said mandrel seat to revolve about said second central axis of said actuating portion for causing said mandrel to be moved to a printing position where an outer surface of a blank can that is on said mandrel may make contact with said printing portion of said blanket wheel.

2. An automated can decorating apparatus according to claim 1, further comprising a trip arm extending generally in a direction radially away from said stub portion, the trip cam follower mounted on said trip arm;

a reset arm extending generally in a direction radially away from said stub portion and angularly spaced from said trip arm, the reset cam follower mounted on said reset arm.

3. An automated can decorating apparatus according to claim 2, further comprising a common sleeve fitted on the said stub portion and said trip arm and said reset arm are connected to said stub portion by said common sleeve.

4. An automated can decorating apparatus according to claim 3, wherein said trip arm and said reset arm are integrally connected by said sleeve to form a unitary body.

5. An automated can decorating apparatus according to claim 1, further comprising an off-center spring connected to a first spring post disposed on said trip cam follower and a second spring post disposed on said support member, wherein said off-center spring pulls said mandrel toward a printing position when said reset cam follower is moved in said second direction and said off-center spring passes over said stub portion.

6. An automated can decorating apparatus according to claim 5, further comprising an adjustment mechanism for adjusting the contact pressure between an outer surface of a blank can that is received on a said mandrel and said printing portion of said blanket wheel, said adjustment mechanism including an adjustable member that abuts against a wall portion connected to said stub portion, wherein said adjustable member imparts force upon said wall portion for twisting said stub portion for selectively relieving or increasing tension in said off-center spring, thereby adjusting the pressure between an outer surface of a blank can that is received on said mandrel and said printing portion of said blanket wheel.

7. An automated can decorating apparatus according to claim 6, wherein said adjustable member comprises a bolt movable within a screw post, said bolt having a tip that abuts said wall portion.

8. An automated can decorating apparatus according to claim 1, comprising at least two of said movable trip cam plates each having a respective said trip cam surface, wherein said trip cam surfaces and said trip cam followers are so positioned that a first group of said trip cam followers engages said trip cam surface on a first one of said trip cam plates and a second group of said trip cam followers engages said trip cam surface on a second one of said trip cam plates.

9. An automated can decorating apparatus according to claim 8, wherein said plurality of mandrel subassemblies alternately include only one said trip cam follower from one of said first group of said trip cam followers and said second group of said trip cam followers.

10. An automated can decorating apparatus according to claim 1, wherein said at least one trip cam plate pivots about a pivot pin.

11. An automated can decorating apparatus according to claim 1, further comprising a piston which is air-activated and is connected to said at least one trip cam plate to move said at least one trip cam plate.

12. An automated can decorating apparatus according to claim 1, wherein said mandrel seat is disposed at an end of said actuating portion of said eccentric shaft opposite to said stub portion.

13. An automated can decorating apparatus according to claim 1, wherein said first and second directions are opposite clockwise and counter-clockwise.

14. An automated can decorating apparatus according to claim 1, wherein said support member is a cantilevered arm extending radially away from said central axis of said mandrel wheel shaft.

15. An automated can decorating apparatus according to claim 1, further comprising an air/vacuum system operatively connected to each mandrel via an air channel extending through said eccentric mandrel shaft.

16. An automated can decorating apparatus according to claim 1, wherein said at least one said trip cam plate is disposed outside the outer periphery of said mandrel wheel, and said reset cam plate is disposed in a position inside the periphery of said mandrel wheel.

17. An automated can decorating apparatus according to claim 1, wherein said mandrel seat comprises a bore in said support member.

18. An automated can decorating apparatus according to claim 17, wherein said actuating portion is rotatably mounted within said bore by a pair of tapered roller bearings separated by an annular divider.

* * * * *